US005697506A

United States Patent [19]

Peickert

[11] Patent Number: 5,697,506

[45] Date of Patent: Dec. 16, 1997

[54] PACKAGE HOLDER FOR PACKAGED FOODS

[76] Inventor: Marlin W. Peickert, P.O. Box 31403, Rio Verde, Ariz. 85263-9999

[21] Appl. No.: 374,231

[22] Filed: Jan. 18, 1995

[51] Int. Cl.[6] ..... A47F 5/00

[52] U.S. Cl. ..... 211/71; 211/73; 211/89; 248/316.7

[58] Field of Search ..... 211/89, 71, 72, 211/73, 113, 51; 248/316.7, 95

[56] References Cited

U.S. PATENT DOCUMENTS

| | | | |
|---|---|---|---|
| 436,600 | 9/1890 | Hartman | 248/316.7 |
| 1,006,334 | 10/1911 | Wright | 40/124.4 |
| 1,665,271 | 4/1928 | Lubbers | 211/72 X |
| 1,676,492 | 7/1928 | Goodwin | 40/124.4 |
| 1,759,862 | 5/1930 | Moore | 40/124.4 |
| 1,940,078 | 12/1933 | Cooper | 206/46 |
| 2,150,802 | 3/1939 | Latsch | 211/89 |
| 3,187,903 | 6/1965 | Oltz | 211/87 |
| 4,461,387 | 7/1984 | Belokin | 211/89 X |
| 5,056,748 | 10/1991 | Meyer | 248/316.7 |
| 5,236,760 | 8/1993 | Jinn | 248/316.7 X |

*Primary Examiner*—Robert W. Gibson, Jr.
*Attorney, Agent, or Firm*—David George Johnson

[57] ABSTRACT

A molded plastic holder (1, 130) for packets includes a substantially flat support panel (11, 132) which is designed to be mounted to any vertical surface. Molded as part of and integrally joined to the support panel (11, 132) along a lower edge (3) is a plurality of curved clips (12, 112) which are displaced outwardly at the base (27) so as to provide a clearance space (31) to receive the packets. The clip (12, 112) includes a retaining wall (24*a*) which joins the base (27) and tilts inwardly toward the support member (11, 132), terminating at an upper edge (7, 9). The clip (12, 112) is biased such that the upper edge (7,9) is urged toward the support member (11, 132).

1 Claim, 4 Drawing Sheets

PACKAGE HOLDER FOR PACKAGED FOODS

FIELD OF THE INVENTION

The present invention relates in general to support holders for packets of dry seasoning, salad dressing and soup mixes, powdered concentrate for soft drinks, similar granular type materials and other like items. More specifically, the present invention relates to a support holder having a substantially flat support panel which includes retention clips to retain the received object in position.

DESCRIPTION OF RELATED TECHNOLOGY

A number of holders and receptacles for packages or printed material have been designed. These holders and receptacles typically include front and rear panels and enclosing side panels. The bottom surface is often enclosed either by a separate panel or by joining the lower edges of the front and rear panels. The interior cavity thus defined is not completely sealed and the material which is received is retained without any particular orientation or arrangement. In some designs, a series of receptacles are provided in a stack such that different types of materials can be segregated.

An example of such a container is disclosed in U.S. Pat. No. 3,187,903, issued to Oltz. Oltz discloses the use of flexible materials that form pouches for holding containers rather than a rigid structure. U.S. Pat. No. 1,940,078, issued to Cooper, discloses a tea bag holder. The Cooper device uses a series of envelopes composed of paper or cellophane.

The Oltz and Cooper devices suffer from the limitation that the package to be retained must be of specific shape and dimensions to be securely retained within the pouches or envelopes, and must oriented correctly and placed carefully within the receptacles in order to prevent crumpling. In an effort to avoid this shortcoming, various retaining clips have been utilized in prior art devices.

An example of such a device is disclosed in U.S. Pat. No. 436,600, issued to Hartman. The Hartman clip includes both a flap and a smaller, interior tongue to accommodate cards or newspapers of various sizes. A sheet holder is disclosed in U.S. Pat. No. 1,006,334, issued to Wright. The Wright apparatus uses a planar clip bent outwardly from a piece of sheet metal stock. A card rack is disclosed in U.S. Pat. No. 1,676,492, issued to Goodwin. The Goodwin rack employs a series of clips bent slightly outwardly from a large sheet, and is thus suitable only for retaining very thin materials having considerable inherent stiffness. U.S. Pat. No. 1,759,862, issued to Moore, discloses a display holder including clips used in conjunction with sidewalls. The Moore device thus loosely retains packages of various shapes and sizes.

Finally, a magazine and newspaper holder is disclosed in U.S. Pat. No. 5,056,748, issued to Meyer. The Meyer device utilizes a curving clip having a bent portion near its top edge. The bent portion serves as the pressure point at which the force of the clip is exerted against the article being retained.

SUMMARY OF THE INVENTION

Manufacturers have resorted to the packaging of materials, particularly food products, in flat rectangular packages. Since these packets are relatively small, they are often misplaced in the kitchen. The present invention provides a unique holder construction which is particularly designed for use in the kitchen whereby food products of the type packaged in small packets can be conveniently and safely stored. The present invention is extremely simple to manufacture and use, and permits the packets in which seasoning, salad dressing, soup mixes and powdered concentrate for soft drinks are kept to be always in view and easily removed from the container.

The present invention serves as a safe and permanent storage facility for the aforementioned containers, and provides a rack which will hold a plurality of packets in separate, readily accessible positions where they can be readily removed and inserted while remaining at least partially visible so as to be distinguished from each other. The holder of the present invention includes a front clip which aids in retaining the articles which are placed in the holder. The clip is molded integrally as part of the holder and has a sufficient spring tension to enable various thicknesses of material to be retained. The spring tension of the clip also creates a slight flex or bend in the received articles such that the outer edges are pushed forward and made easier to grasp. The present invention is provided with pressure sensitive tape as well as mounting holes for attachment to a vertical surface such as a kitchen cabinet door.

A holder for packets according to one embodiment of the present invention includes a substantially flat support panel and curved clips integrally formed with the support panel. The curved clips join the support panel along one of their edges and are free from the support panel around their remaining periphery. The clips have an inside surface which defines a receiving cavity with the outer surface of the support panel.

DETAILED DESCRIPTION OF THE PREFERRED EMBODIMENTS

Figure 1:
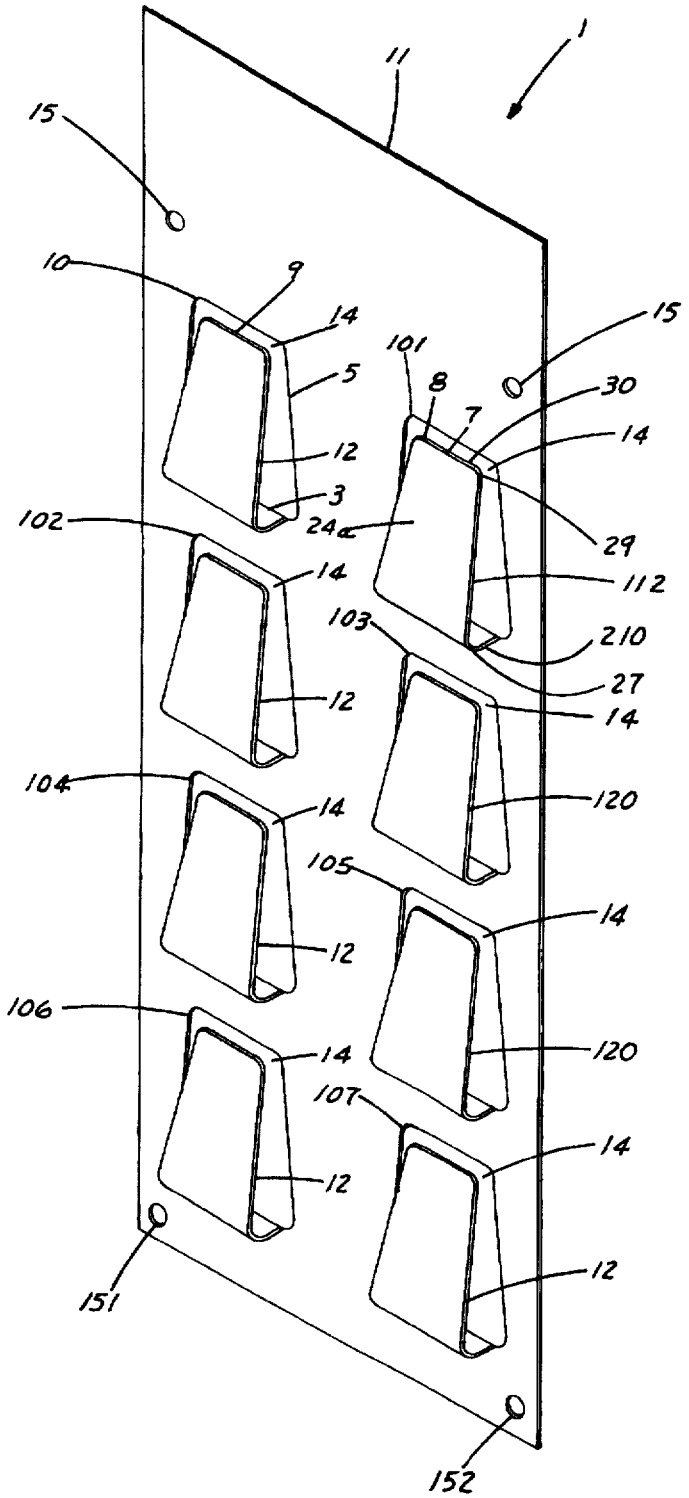
FIG. 1 is a perspective view of a holder constructed in accordance with the principles of the present invention.

For the purposes of promoting an understanding of the principles of the present invention, reference will now be made to the embodiments illustrated in the drawings and specific language will be used to describe the invention. Nevertheless, no limitation of the scope of the invention is thereby intended. Alterations and modifications of the illustrated device, and further applications of the principles of the invention are contemplated as would normally occur to one skilled in the field to which the invention relates.

Figure 2:
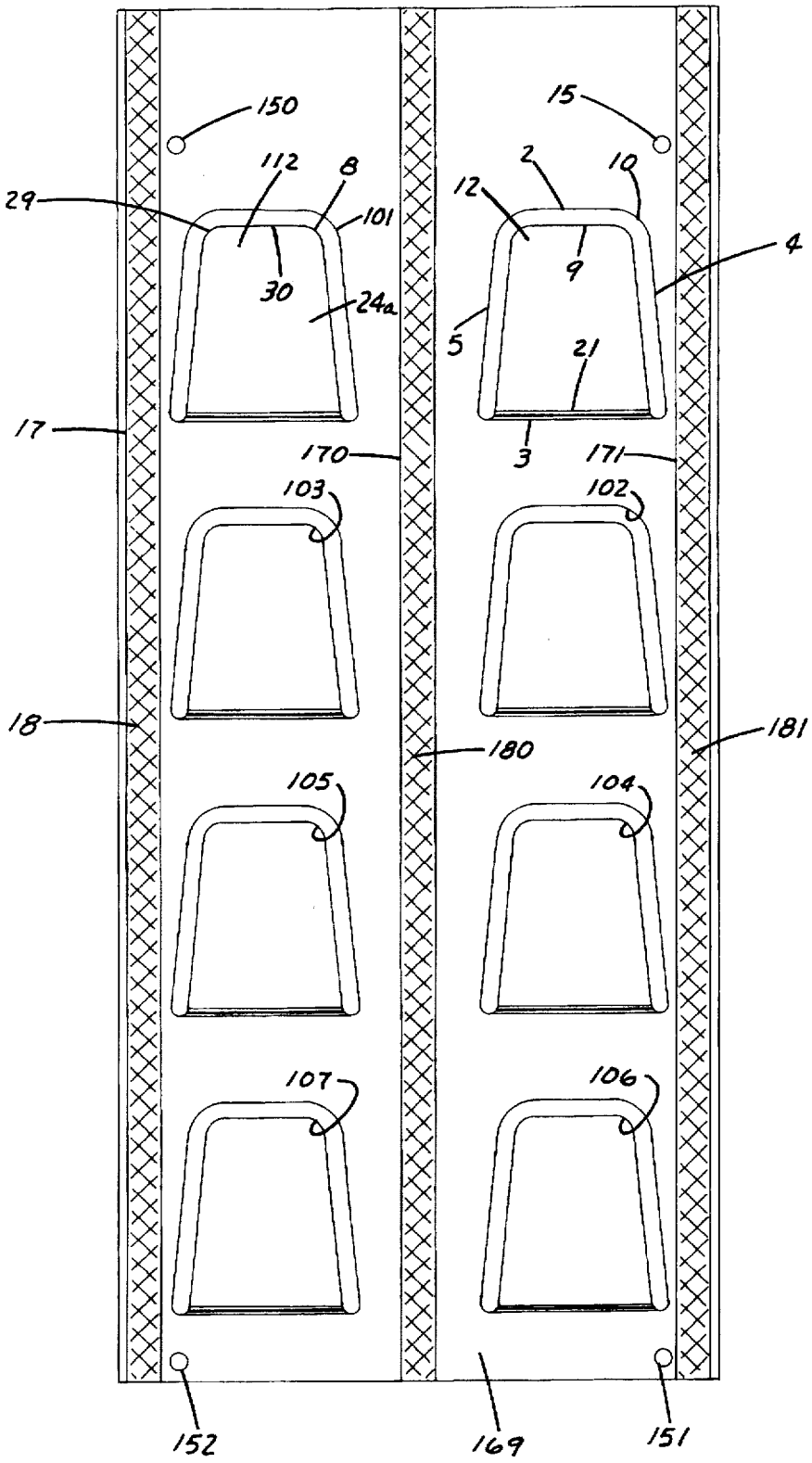
FIG. 2 is a rear elevation of the holder depicted in FIG. 1.

Referring to FIG. 1, the packet holder 1 constructed according to the principles of the present invention is illustrated. The packet holder 1 includes a support panel 11 which is formed as a generally rectangular, substantially flat integral member. Ideally, the panel 11 is composed of a transparent plastic material such as polyethylene or polystyrene, and has a uniform thickness in the range of 0.05 to 0.20 inches. The panel 11 may be of various sizes and is typically in the range of twelve to twenty four inches in width and eighteen to thirty inches in height. The support panel is formed to include a series of portals or openings 10, 101, 102, 103, 104, 105, 106 and 107. The portals 10 and 101–107 are substantially identical in shape and dimensions. As best seen in FIG. 2, portal 10, for example, is generally trapezoidal in shape and includes a relatively shorter top edge 2 and an opposite, relatively longer bottom edge 3. In one preferred embodiment, the top edge 2 is approximately four inches in length while the bottom edge 3 is approximately six inches long. The sides 4 and 5 of portal 10 are each approximately seven inches long. The novel trapezoidal shape of the portal 10 is helpful in securing packages of different sizes without crumpling the package or exerting undue force on the package contents.

Figure 3:
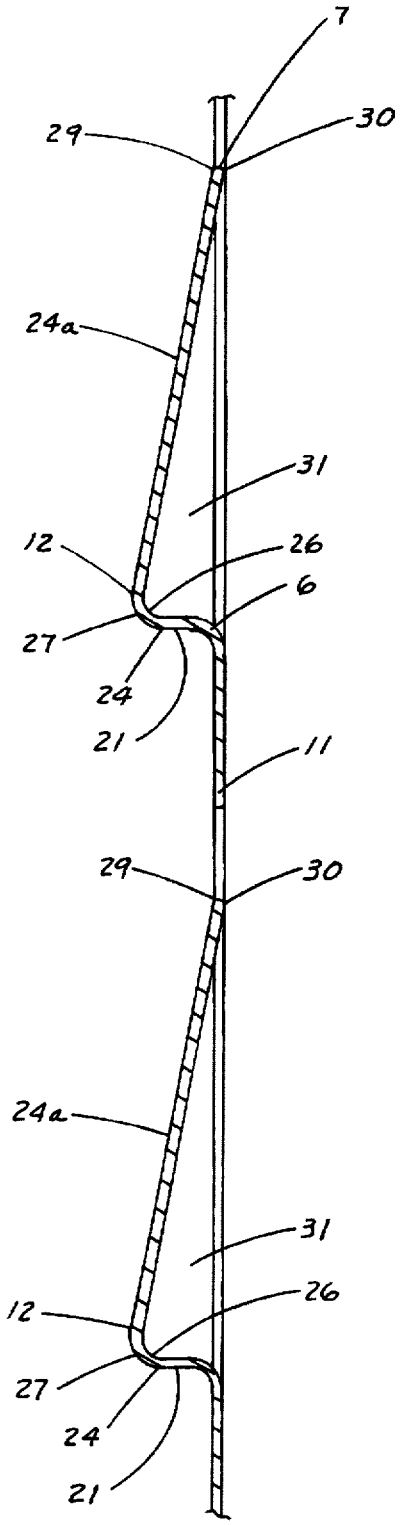
FIG. 3 is a side elevation of the holder depicted in FIG. 1.

Joining the bottom edge 3 of portal 10 is a curved clip 12, which is injection molded integrally with support panel 11. As best seen in FIG. 3, the clip 12 is formed to include a bottom member 21 which is substantially perpendicular to the plane of support member 11. As best seen in FIG. 3, a ninety degree radius 6 transitions between bottom member 21 and support member 11. Section 24 curves upwardly from bottom member 21 and is configured with a smoothly curved concave inner surface 26 and convex outer surface 27. Section 24 terminates at retaining wall **24*a* which is a substantially flat member of uniform thickness extending upwardly from bottom member 21 and rearwardly toward support member 11**.

The upper edge 7 of retaining wall **24*a* terminates at rear ledge 30 which extends for substantially the entire width of upper edge 7. The retaining wall 24*a* is substantially trapezoidal in shape and includes a radiused right corner 29 and a radiused left corner 8. The volume between the retaining wall 24*a* and the plane of the support member 11 defines an open cavity 31. As so designed, a seasoning mix packet or other granular packet (not shown) may be inserted between retaining wall 24*a* and the plane of support member 11. The bottom of the packet (not shown) may rest against lower surface 26, and the upper portion or flap (not shown) of the packet will be pinched between the rear ledge 30 of retaining wall 24*a* and the adjacent portions of support member 11**.

The clips 12 and 112 are horizontally aligned such that the bottom member 210 of clip 112 is coplanar with the bottom member 21 of clip 12. This permits the insertion of a packet (not shown) that is substantially wider than the single clip 12 so as to span both clip 12 and adjacent clip 112. The packet cannot move or shift laterally because of the grip exerted by the pressure of ledges 30 and 9 against the packet. Regardless of the width of the packet to be retained by one or more clips, the packet is inserted into the clip 12, for example, via the gap 14 adjacent to the ledge 9. The greater the distance that ledge 9 is displaced outwardly from the plane of support member 11, the greater the compressive force exerted on articles by the ledge 9. The inherent flexural modulus of the plastic material used to form the clip 12, for example, permits the ledge 9 to translate along a line that is perpendicular to the plane of support member 11.

In practice, the clips 12, 112, etc. are of the same shape and size to provide uniformity in the construction of holder 1. However, the holder 1 can be used to hold packets of varying shapes and sizes, with the result being that peripheral portions of the packets may overlap a portion of an adjacent packet. This is a desirable result, however, since the top or upper portion of each packet will be visible and held outwardly for easy grasping by the support member 11 or, if the packet is sufficiently large, by the adjacent concave surface 27 of the clip 112, for example, immediately above the clip 120, for example, which is retaining the article to be grasped.

The holder 1 may be mounted to a flat surface in a variety of ways. Mounting holes 15, 150, 151 and 152 are placed along the periphery of support member 11 to permit mounting with screw or rivets. Also, pressure sensitive adhesive areas 17, 170 and 171 are provided on the rear surface 169 of the holder 1. Protective strips 18, 180 and 181 are provided to cover the adhesive areas 17, 170 and 171, respectively, when the holder 1 is manufactured, and eliminate any inconvenience resulting from handling the holder 1 prior to its installation. Upon removing the strips 18, 180 and 181, the holder 1 can be pressed against a wall or cupboard door for mounting thereon.

Figure 4:
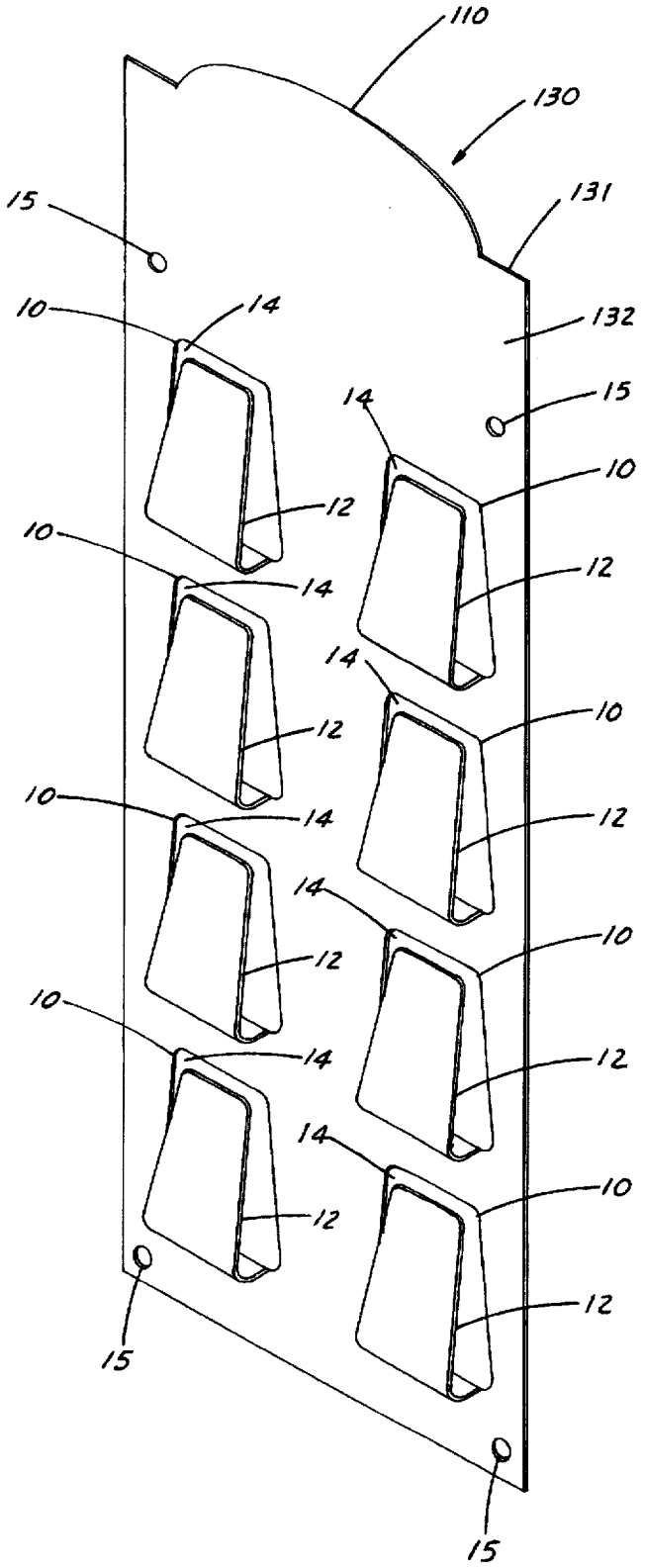
FIG. 4 is a perspective view of a second embodiment of a holder constructed in accordance with the principles of the present invention.

Referring to FIG. 4, an alternate embodiment of the holder 130 is shown. The upper edge 131 of the support member 132 is formed to include a billboard region 110. Region 110 is useful for situations where the holder 30 is to be used in a public setting, such as a store. In that case, an advertiser's logo or the like may be placed in region 110 by means of a decal or the like. Further, a manufacturer of packaged foods could distribute the holder 30 as a promotional item. In the latter case, the holder 30 would be used in a private setting, such as a home, thereby serving as a reminder or adverisement to the user to purchase packaged foods of that particular brand.

The disclosure of the present invention is intended to be illustrative, but not limiting, of the scope of the invention, which is set forth in the following claims.

I claim:

1. A packet rack holder construction with a plurality of clips for holding flexible, deformable packages containing seasoning, salad dressing and soup mixes, powdered concentrate for soft drinks, similar granular materials and the like comprising:

(a) a substantially flat support panel;

(b) at least four slots formed within the support panel, the slots defining substantially planar void regions, each slot further comprising;

(i) a substantially trapezoidal shape having radiused corners;

(ii) a relatively shorter top linear edge, each top linear edge being colinear with one other top linear edge of an adjacent slot; and (iii) a relatively longer bottom edge, the bottom edge being parallel to the top edge, the bottom edge being collinear with the bottom edge of an adjacent slot;

(c) a tongue positioned adjacent to each slot, the tongue being formed to include a tip region, the tip region having a linear upper edge parallel to the top linear edge of each slot, the tip region of the tongue protruding into the substantially planar void region defined by each slot, the tongue being adapted to secure an article between the tip region of the tongue and the substantially flat support panel;

(d) an integrally formed transparent polyethylene sheet having a uniform thickness of between 0.05 and 0.20 inches, the polyethylene sheet forming the support panel and each tongue; and (e) an enlarged semielliptical upper region, the upper region being coplanar with the support panel.

* * * * *